US006152208A

United States Patent [19]

Kalempa et al.

[11] Patent Number: 6,152,208

[45] Date of Patent: Nov. 28, 2000

[54] FLEXIBLE DOOR WITH ACTUATABLE SEALING MECHANISM

[75] Inventors: Walenty Kalempa, Slinger; Christopher C. Genthe, West Bend, both of Wis.

[73] Assignee: Rytec Corporation, Jackson, Wis.

[21] Appl. No.: 09/379,276

[22] Filed: Aug. 23, 1999

Related U.S. Application Data

[60] Provisional application No. 60/103,954, Oct. 13, 1998.

[51] Int. Cl.[7] ..... A47G 5/02

[52] U.S. Cl. ..... 160/273.1; 160/118; 49/477.1; 52/2.11

[58] Field of Search ..... 160/41, 118, 268.1, 160/229.1, 117, 273.1, 271; 49/477.1; 52/2.11

[56] References Cited

U.S. PATENT DOCUMENTS

| | | | |
|---|---|---|---|
| 2,009,445 | 7/1935 | Gould . | |
| 2,132,986 | 10/1938 | Julien . | |
| 3,098,519 | 7/1963 | Meyers et al. . | |
| 3,438,150 | 4/1969 | Heim | 49/477.1 X |
| 3,516,471 | 6/1970 | Harkins et al. . | |
| 3,984,942 | 10/1976 | Schroth . | |
| 4,150,509 | 4/1979 | Knap | 49/477.1 X |
| 4,177,353 | 12/1979 | McCormack | 49/477.1 X |
| 4,250,941 | 2/1981 | McNally | 49/477.1 X |
| 4,293,969 | 10/1981 | Frommelt . | |
| 4,399,317 | 8/1983 | Van Dyke, Jr. | 49/477.1 X |
| 4,579,192 | 4/1986 | Mueller . | |
| 4,594,742 | 6/1986 | Zeigler et al. | 160/118 X |
| 4,649,981 | 3/1987 | Bibeau | 160/273.1 X |
| 4,746,765 | 5/1988 | Mallott . | |
| 4,750,299 | 6/1988 | Frommelt et al. . | |
| 4,800,946 | 1/1989 | Rosenoy . | |
| 4,961,454 | 10/1990 | Reilly, Jr. et al. | 160/118 X |
| 5,183,093 | 2/1993 | Kraeutler . | |
| 5,339,488 | 8/1994 | Maass | 49/477.1 X |
| 5,475,948 | 12/1995 | Parke . | |
| 5,549,149 | 8/1996 | Sills et al. . | |
| 5,794,678 | 8/1998 | Beringer et al. . | |
| 5,899,303 | 5/1999 | Allen | 160/118 X |
| 5,964,270 | 10/1999 | Kirkey et al. | 160/273.1 |
| 6,003,583 | 12/1999 | Lacoste et al. | 160/273.1 X |

OTHER PUBLICATIONS

Seal Master Inflatable Seals, Sales Brochure, pp. 1–6.

*Primary Examiner*—Bruce A. Lev
*Attorney, Agent, or Firm*—Wallenstein & Wagner, Ltd.

[57] ABSTRACT

A door assembly comprising a non-rigid door panel which is selectively moved to open and close an opening, the opening having a perimeter defined by opposed first and second sides, a top and a bottom. The door panel includes a first frame member positioned proximate and extending along at least a portion of the perimeter of the opening and a second frame member spaced apart from and co-aligned with the first frame member to define a through-way for passage of a margin of the door panel therethrough. At least a portion of at least one of either the first frame member or the second frame member includes a movable member that pushes the door panel toward at least a portion of the other of the first or second frame members when the door panel is in the through-way thereby sealing the margin of the door.

19 Claims, 4 Drawing Sheets

FLEXIBLE DOOR WITH ACTUATABLE SEALING MECHANISM

This application claims benefit to provisional Application 60/103,954 filed Oct. 13, 1998.

TECHNICAL FIELD

The invention relates to industrial doors, and in particular to high-performance doors used to prevent light from entering light-sensitive areas.

BACKGROUND OF THE INVENTION

Recently, there has been a need for developing a door with ample capacity to prevent entry or escape of light through a doorway. In particular, in industries such as the photography industry, it is desirable to restrict light from entering an area. Moreover, it is desirable to restrict light from entering or escaping through a doorway equipped with a high-speed door.

Doors with various types of sealing mechanisms have been employed for various applications. For example, U.S. Pat. No. 3,984,942 to Schroth provides an inflatable seal for a sliding door. However, the sealing assembly in Schroth is for use only with rigid doors, and would not provide an adequate seal for a flexible or non-rigid door panel.

Other doors with sealing mechanisms have been developed for various application including, sanitary applications and refrigeration. For example, some prior designs have employed brushes positioned at the margin of the door to restrict entry of contaminants or to provide temperature maintenance. However, these prior designs do not provide adequate sealing for light-sensitive applications. The present invention provides a door assembly for light-sensitive applications which solves these and other problems.

SUMMARY OF THE INVENTION

The present invention provides a door assembly with an actuatable seal that prevents entry or escape of light through an opening.

A door is provided having a non-rigid door panel which is selectively moved to open and close an opening. The opening has a perimeter which is defined by opposed first and second sides, a top and a bottom. The door assembly further includes a first frame member and a second frame member. The first frame member is positioned proximate to and extends along at least a portion of the perimeter of the opening. The second frame member is spaced apart from, and co-aligned with, the first frame member to define a throughway for passage of a margin of the door panel therethrough. At least a portion of at least one of either the first frame member or the second frame member includes a movable member that pushes the door panel toward at least a portion of the other of the first or second frame members when the door panel is in the throughway, thereby sealing the margin of the door.

Other advantages and aspects of the present invention will become apparent upon reading the following description of the drawings and detailed description of the invention.

DETAILED DESCRIPTION OF THE PREFERRED EMBODIMENT

Figure 1:
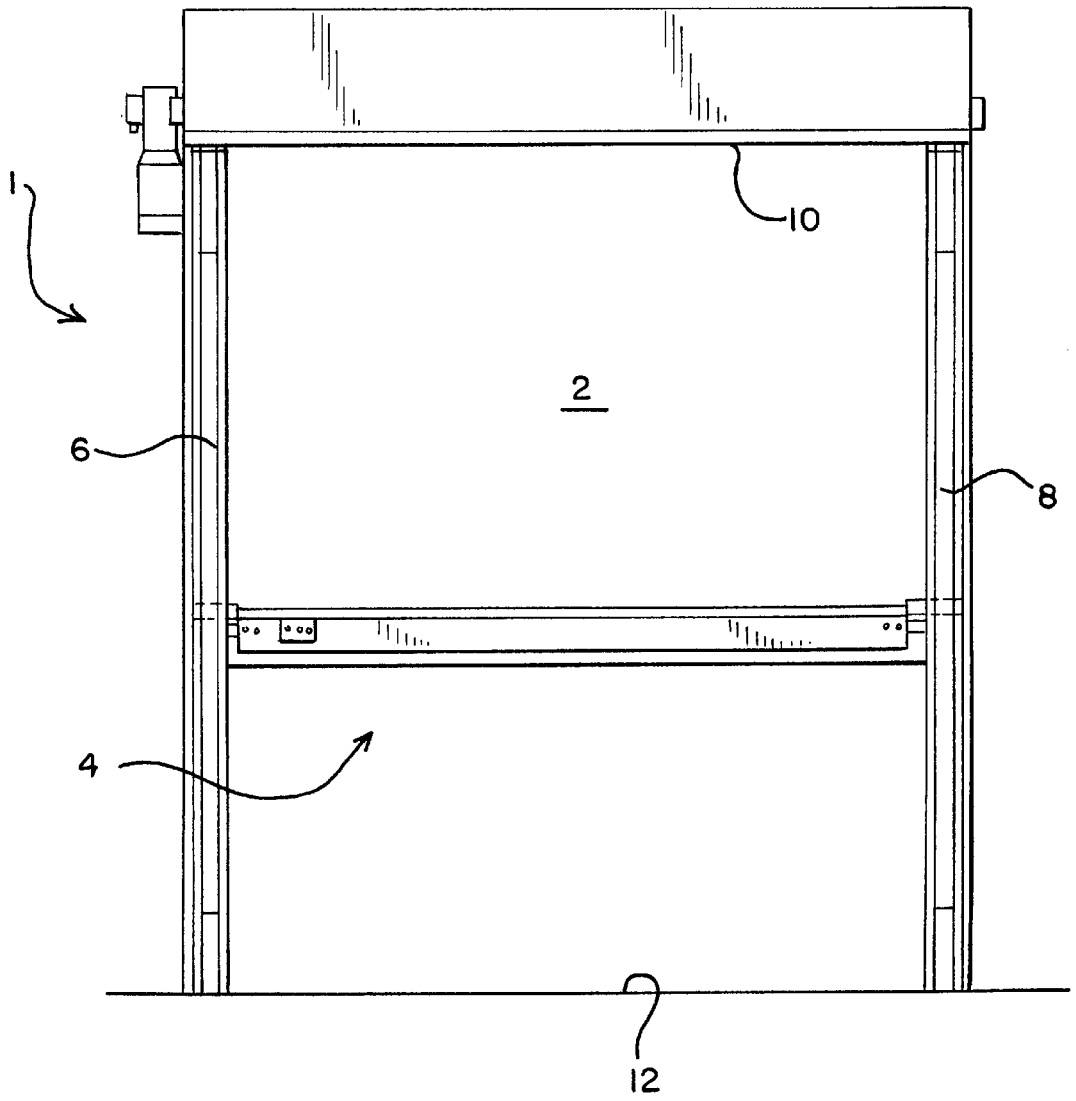
FIG. 1 is a front view of a roll-up overhead door according to the present invention.
Figure 1A:
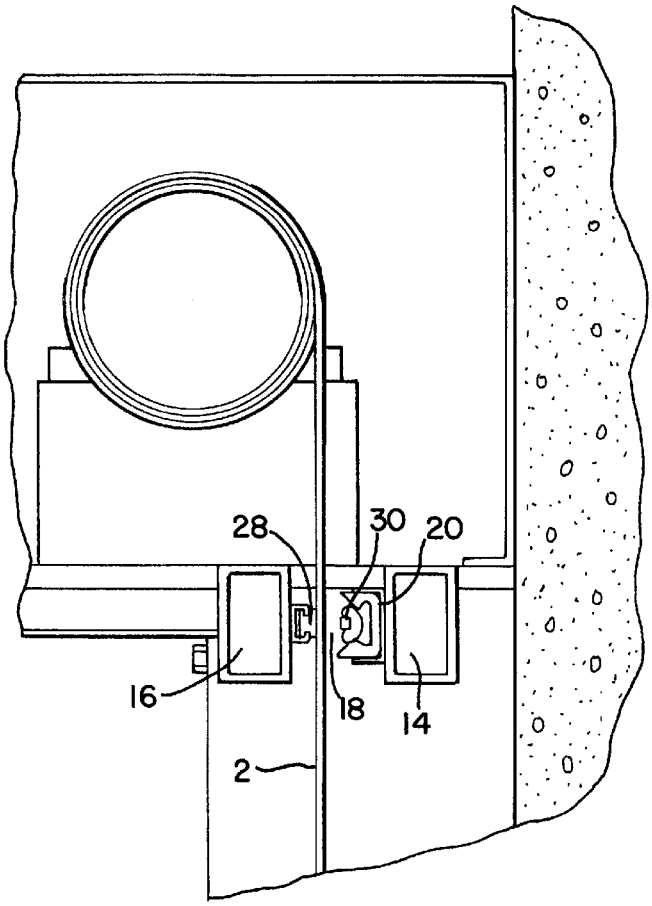
FIG. 1*a* is a side view of a roll-up overhead door assembly according to the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1–6 illustrate a door assembly 1 according to the present invention. Generally, the door includes an actuatable sealing mechanism for sealing a space to prevent entry of light therein. According to one aspect of the present invention, a door assembly 1 having a non-rigid door panel 2 which is selectively moved to open and close an opening 4 is disclosed. The opening 4 has a perimeter defined by opposed first and second sides (6, 8), a top 10 and a bottom 12.

Figure 2:
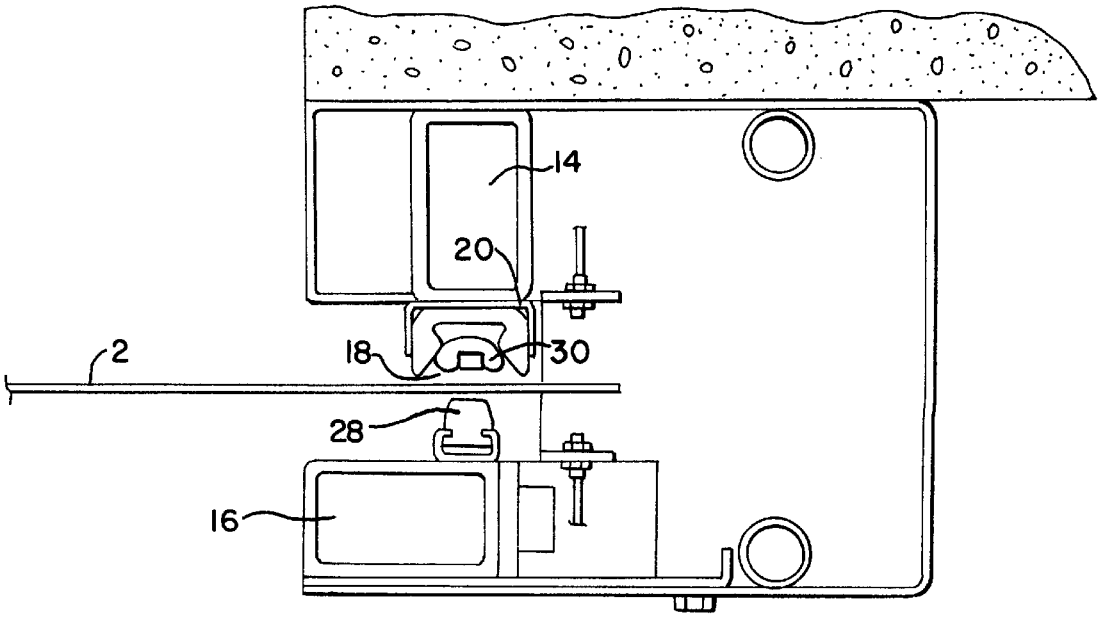
FIG. 2 is a top cross-sectional view of an overhead door assembly according to the present invention.
Figure 3:
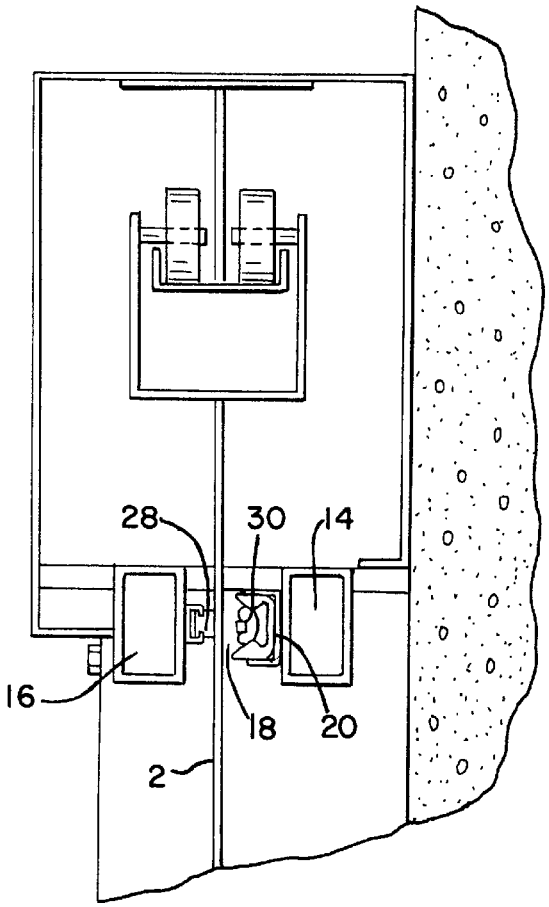
FIG. 3 is a side view of a flexible sliding panel door assembly according to the present invention.

As shown in FIGS. 1–3, the door assembly 1 includes a first frame member 14 and a second frame member 16. The first frame member 14 is positioned generally proximate and extending along at least a portion of the perimeter of the opening 4. The second frame member 16 is spaced apart from, and co-aligned with, the first frame member 14 to define a throughway 18.

As may be seen in FIG. 2, a margin of the door panel 2 passes between the first and second frame members (14, 16). The assembly is configured such that at least a portion of at least one of either the first or second frame members (14, 16) includes a movable member 20. When the door panel 2 is in the throughway 18, and the movable member 20 pushes the door panel 2 toward the other of the frame members. Thus, the margin of the door is sealed and light is generally prevented from entering the opening 4 by way of the margins of the panel 2.

Figure 4:
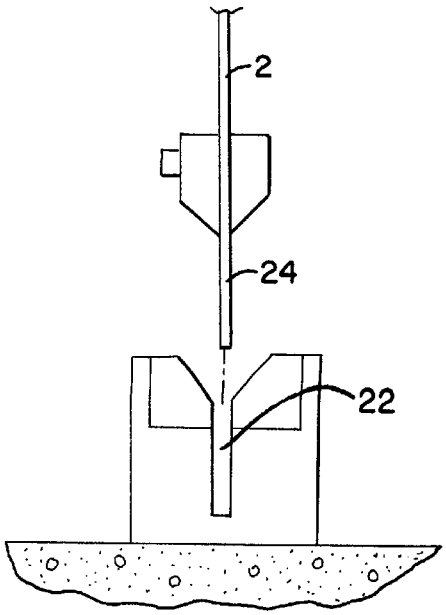
FIG. 4 is a side view of the lower edge of the door panel according to the present invention.

As illustrated in FIG. 4, The door assembly 1 further includes a receptacle 22 for receiving a bottom margin 24 of the door panel 2. Upon closing the door, the bottom margin 24 of the door panel 2 is received into the receptacle 22 causing the bottom 12 of the opening 4 to be sealed. FIG. 4 shows the receptacle 22 entrenched below the surface of the bottom 12 of the opening 4. However, it is contemplated that the receptacle 22 is included in a track along the bottom 12 of the opening 4, or even more preferably, that the receptacle 22 is formed by a bottom portion of the frame members (14, 16).

Figure 5:
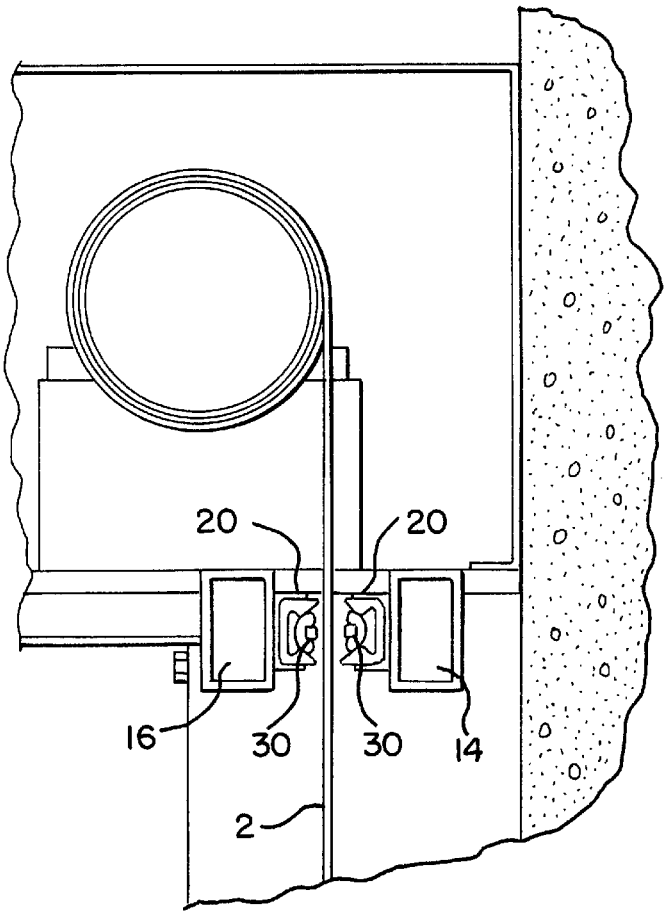
FIG. 5 is a side view of another embodiment of an overhead door assembly according to the present invention; and, FIG. 6 is a top cross-sectional view of another embodiment of an overhead door assembly according to the present invention.
Figure 6:
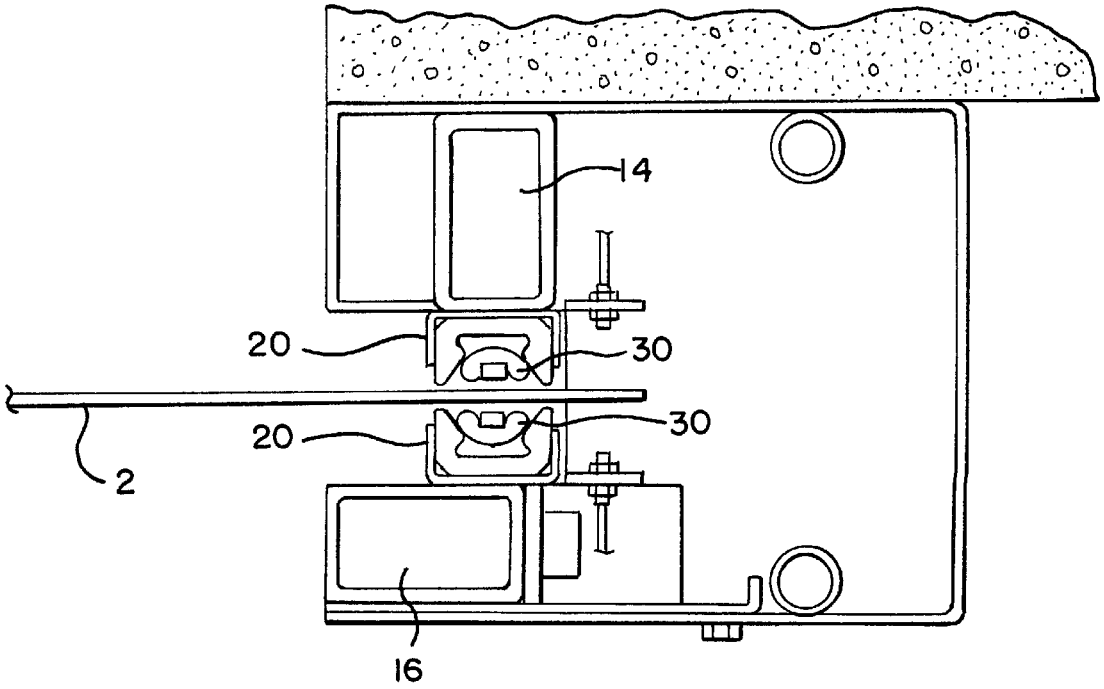

In the preferred embodiment, at least a portion of one of the frame members (14, 16) includes a bumper 28 connected thereto, while the other of the frame members (14, 16) has a fluid inflatable pressure seal 30 connected thereto. The pressure seal 30 is generally positioned in corresponding spacial alignment with the bumper 28 such that when the seal is at least partially inflated, the door panel 2 is secured against the opposed bumper 28. Typically, the frame members (14, 16), and thus the bumper 28 and pressure seal 30, extend proximate to and along the first side, the second side and the top 10 of the perimeter of the opening 4. However, it is contemplated that the frame members (14, 16), and thus the bumper 28 and pressure seal 30, extend proximate to and along only the opposed sides of the perimeter. Likewise, the frame members (14, 16) may extend proximate to and along the entire perimeter of the opening 4, such that the door panel 2 may be sealed along its entire margin. Furthermore, while the preferred embodiment has an inflatable pressure seal 30 connected to one frame member and a bumper 28 on the opposed frame member, it is contemplated that both frame members (14, 16) have inflatable pressure seals 30 connected thereto (FIGS. 5 and 6).

Typically, the inflatable pressure seal 30 is a commercially available pneumatic or otherwise inflatable seal. The pressure seal 30 is operatively connected to a means to inflate the seal. It is contemplated that the means to inflate the pressure seal 30 may be a stand-alone electric generator and pump, a manual pump, or any other device suitable for actuating the seal. Additionally, the means for inflating the pressure seal 30 is typically electrically connected a means for moving the door panel 2 between an opened and closed position. This configuration allows the pressure seal 30 to be inflated to its "sealed position" when the door is in a generally closed position, and to be at least partially deflated before the door begins to move to the open position. The means for moving the door panel 2 may be any controller suitable for moving a door panel 2.

Furthermore, as the door panel 2 is moved between an open and closed position, the door panel 2 often is caused to rub on either bumper 28 or the pressure seal 30. This abrasion of particular concern because of the high-speed applications to which the door, and particularly the flexible door panel 2 is subject. Therefore, in order to reduce the friction and thereby decrease wear on the door panel 2, the present door assembly 1 further includes a low-friction material on at least a portion either or both the bumper 28 and pressure seal 30.

Although, the preferred embodiment of the present invention is a door assembly 1 wherein the door panel 2 is accumulated overhead, the assembly may also be used with other door panel 2 configurations (FIG. 3). For example, the door panel 2 may be a single sliding flexible door, or a pair of flexible sliding door panels 2 that move horizontally, one toward the other, across the opening 4 and meet to close the opening 4. As may be seen in FIG. 3 the alternate embodiments of the door panel 2 configuration are generally constructed to include the elements of the door assembly 1.

What is claimed is:

1. A door assembly which is selectively moved to open and close an opening, the opening having a perimeter defined by opposed first and second sides, a top and a bottom, the door assembly comprising:

a non-rigid flexible door panel;

a first frame member positioned proximate and extending along at least a portion of the perimeter of the opening;

a second frame member spaced apart from and co-aligned with the first frame member to define a through-way for passage of a margin of the door panel therethrough wherein at least a portion of at least one of either the first frame member or the second frame member includes a movable member; and, means for moving the movable member such that the movable member pushes the door panel toward at least a portion of the other of the first or second frame members when the door panel is in the through-way thereby sealing the margin of the door.

2. The door of claim 1 wherein the first frame member and the second frame member extend proximate to and along both the first and second sides of the perimeter of the opening.

3. The door of claim 2 wherein the first frame and the second frame member further extend proximate to and along the top of the perimeter of the opening.

4. The door of claim 2 further including a bumper connected to at least a portion of one of either of the first frame member or second frame member and a fluid inflatable pressure seal connected to at least a corresponding portion of the other of either of the first frame or the second frame members, the pressure seal being operatively connected to a means for inflating the seal such that the seal secures the door panel against the bumper when the seal is at least partially inflated.

5. The door of claim 4 wherein the means for inflating the pressure seal is electrically connected to a means for moving the door panel between an opened and closed position, such that the pressure seal is inflated so that the seal secures the door panel against the bumper when the door is in a generally closed position, and the pressure seal is at least partially deflated before the door starts to move to the open position.

6. The door of claim 4 further including a low-friction material on at least a portion of at least one of the bumper and pressure seal such that friction is reduced as the door moves between an open and a closed position.

7. The door of claim 2 wherein a receptacle for receiving a bottom margin of the door panel is provided thereby causing the bottom of the opening to be sealed when the bottom margin is received in the receptacle upon closing of the door.

8. The door of claim 2 wherein the door panel is accumulated overhead.

9. The door of claim 2 wherein the door panel is a single sliding flexible door panel that moves horizontally across the opening.

10. The door of claim 2 wherein the door panel comprises a first sliding flexible door panel and a second flexible sliding door panel that move horizontally, one toward the other, across the opening and meet to close the opening.

11. The door of claim 1 wherein the first frame and the second frame member extend proximate to and along the top of the perimeter of the opening.

12. The door of claim 11 wherein the first frame and the second frame member further extend proximate to and along the bottom of the perimeter of the opening.

13. The door of claim 11 further including a bumper connected to at least a portion of one of either of the first frame member or second frame member and a fluid inflatable pressure seal connected to at least a corresponding portion of the other of either of the first frame or the second frame members, the pressure seal being operatively connected to a means for inflating the seal such that the seal secures the door panel against the bumper when the seal is at least partially inflated.

14. The door of claim 13 wherein the means for inflating the pressure seal is electrically connected to a means for moving the door panel between an opened and closed position, such that the pressure seal is inflated so that the seal secures the door panel against the bumper when the door is in a generally closed position, and the pressure seal is at least partially deflated before the door starts to move to the open position.

15. The door of claim 13 further including a low-friction material on at least a portion of at least one of the bumper and pressure seal such that friction is reduced as the door moves between an open and a closed position.

16. The door of claim 11 wherein a receptacle for receiving a bottom margin of the door panel is provided thereby causing the bottom of the opening to be sealed when the bottom margin is received in the receptacle upon closing of the door.

17. The door of claim 11 wherein the door panel is accumulated overhead.

18. The door of claim 11 wherein the door panel is a single sliding flexible door panel that moves horizontally across the opening.

19. The door of claim 11 wherein the door panel comprises a first sliding flexible door panel and a second flexible sliding door panel that move horizontally, one toward the other, across the opening and meet to close the opening.

* * * * *